United States Patent [19]

Payen

[11] 4,420,927

[45] Dec. 20, 1983

[54] PROCESS FOR THE MANUFACTURE OF A FANCY YARN

[76] Inventor: Pierre Payen, 53, rue Chaziere, 69004 Lyons, France

[21] Appl. No.: 311,404

[22] Filed: Oct. 14, 1981

[30] Foreign Application Priority Data

Oct. 14, 1980 [FR] France ..... 80 22186

[51] Int. Cl.[3] ..... D02G 1/02

[52] U.S. Cl. ..... 57/288; 57/282; 57/290

[58] Field of Search ..... 57/58.57, 58.59, 59, 57/60, 282, 284, 287, 288, 290, 309, 310, 328–331

[56] References Cited

U.S. PATENT DOCUMENTS

| | | | |
|---|---|---|---|
| 3,771,307 | 11/1973 | Petrille . | |
| 3,772,872 | 11/1973 | Piazza et al. . | |
| 4,287,113 | 9/1981 | Bromley | 57/290 X |
| 4,329,841 | 5/1982 | Mang | 57/288 |
| 4,335,572 | 6/1982 | Pope | 57/288 X |

FOREIGN PATENT DOCUMENTS

| | | |
|---|---|---|
| 1125101 | 10/1956 | France . |
| 1583253 | 10/1969 | France . |
| 1586716 | 2/1970 | France . |
| 2110644 | 6/1972 | France . |
| 2151896 | 4/1973 | France . |

*Primary Examiner*—Donald Watkins
*Attorney, Agent, or Firm*—Parkhurst & Oliff

[57] ABSTRACT

The invention concerns an improved process for the manufacture of a fancy yarn, in particular of the crepe effect and of the kind where a multifilamentary yarn is overtwisted, then subjected to a false-twist texturing treatment carried out in the same twisting direction as the overtwist, which is characterized in that the basic multifilamentary yarn is a partly stretched synthetic yarn, and the complementary stretching is carried out simultaneously with the false-twist texturing.

3 Claims, 1 Drawing Figure

PROCESS FOR THE MANUFACTURE OF A FANCY YARN

Figure 1:
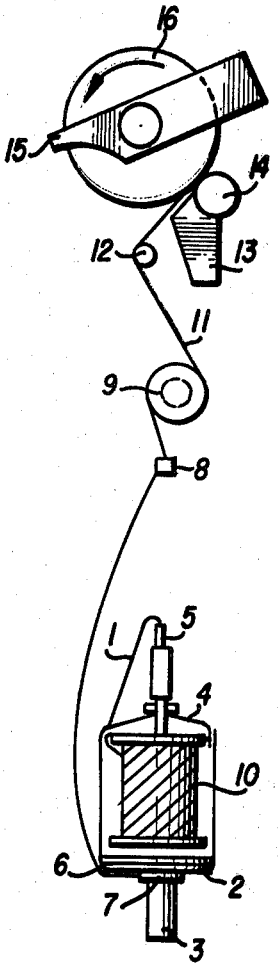
Figure 2:
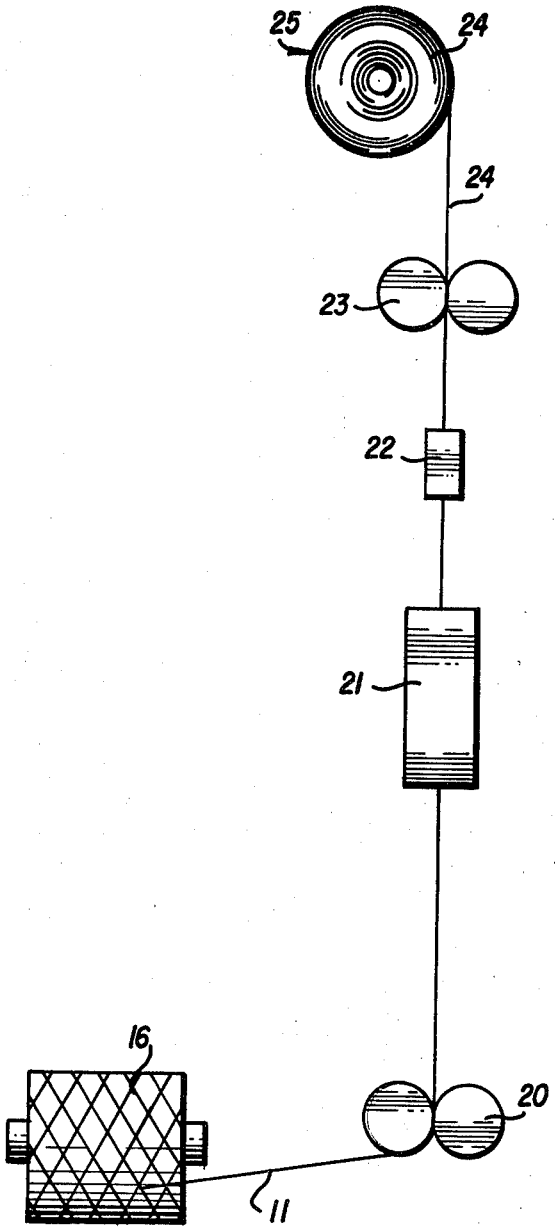

The invention concerns a novel process for manufacturing a fancy yarn, making it possible to obtain crepe-effect fabric with an improved covering power.

As is known, a "crepe" yarn is a yarn which when woven into a suitable weave and after having been subjected to an appropriate treatment results in fabrics with a characteristic wavy appearance. These yarns are strongly twisted. However this twisting varies as a function of the size and is limited downward by a drop in the creping ability and upward by the tendency of the yarn to curl.

A presently widespread method for preparing crepe yarn from continuous multifilamentary synthetic yarns consists in:

strongly twisting said synthetic yarn (for instance at the rate of 1000 turns per meter) either on a throwing mill or on two-for-one twisting spindles in a first stage, and thereupon, in a second stage, subjecting this overtwisted yarn to a texturing treatment by false twisting (not fixed again) wherein the direction of the false twist is identical with that of the overtwist of the first stage in order not to untwist the yarn in the texturing oven.

This solution is quite widespread presently and provides threads with excellent properties. Illustratively, a 70 denier thread is twisted at 1100 turns/m and a 100 denier thread at 900 turns/m. However, as is known, the twisting operation is long and costly. Frequently it amounts to more than half the production costs of these crepe yarns.

The invention alleviates these drawbacks. It relates to an improved process of making fancy yarns, particularly of the crepe appearance, starting from synthetic multifilamentary threads, offering the same advantages as the yarns made to-date but which are definitively more economical to manufacture.

It is known that during the manufacture of such multifilamentary chemical yarns such as nylon and polyester, the main steps consist in extruding the molten material through a die and then stretching or drawing the yarn in order to orient the molecules so as to impart optimal characteristics, and finally to submitting the formed yarn to a winding operation. As a rule, the yarn is wound or stored on a support between each of these operations, whereby numerous handling operations, substantial storage and a danger of mixing the materials are incurred. It is obvious that such a procedure is costly and requires using different materials to carry out these different operations.

In order to reduce the number of operations and to increase productivity, it has been proposed through the last decade to combine the stretching operation either with the extrusion operation or with subsequent treatments, for instance with the texturing operation.

Again it has been proposed to carry out a partial stretching of the yarn during the extrusion, the complementary stretching taking place later. Such yarns are well known and currently are called POY (pre-oriented yarns).

This latter technique is described in particular in the French Patent No. 2,151,896 (corresponding to U.S. Pat. Nos. 3,771,307 and 3,772,872 of E. I. DUPONT DE NEMOURS & CO.) which concerns false-twist texturing wherein the supply yarn is a partly stretched polyester yarn, the partial stretching of the filaments being achieved by extruding them at a rate between 2560 and 4100 m/min.

The POY yarns so obtained evince a birefringence of at least 0.25, a crystallinity of less than 30%, an elongation at rupture of less than 180% and a friction coefficient between yarns not exceeding 0.42. These yarns are well known to the experts in false-twist texturing, where they have become quite common.

To date, these partly drawn yarns have been used mostly in texturing, the complementary stretching being carried out during the texturing operation.

In a most unexpected way, it has now been discovered that these partly stretched yarns could be used for the manufacture of fancy yarns, in particular for a crepe effect. This is the object of the present invention.

The improved process of the invention, which is of the type wherein a synthetic multifilamentary yarn is overtwisted and this overtwisted yarn is then subjected to a texturing treatment by false twisting carried out in the same direction as the overtwisting, is characterized in that the basic multifilamentary yarn is a partly stretched synthetic yarn, and in that the complementary stretching is carried out simultaneously with the false-twisting texturing operation.

In a wholly unexpected manner, it has been observed that in order to achieve the same crepe effect as in the method presently in use, it suffices to overtwist the partly stretched yarn only at the rate of about 600 turns/m. Now, considering that the complementary stretching carried out simultaneously with the false twist texturing (draw-in) is about two times higher, it would have been expected that this yarn should be overtwisted at twice the rate for the standard raw yarn - namely about 2000 turns/m in order to obtain the same finished yarn twisting to achieve the same results. To the contrary, however, a twisting of half the standard rate offers results which are just as good. This is all the more important when viewed in light of the direct financial impact of the overtwisting stage on the yarn costs.

This partly stretched multifilamentary synthetic yarn may be any of the yarns considered provided it lends itself to false-twisting treatment. Advantageously, the commercially noted POY yarns (with a residual stretch ratio of less than 2 obtained by spinning at a rate greater than 3000 m/min) or MOY yarns (medium-oriented yarn, with a residual stretch ratio between 2 and 3 and obtained by spinning at about 2,500 m/min) are used. The sizes of these yarns are selected as a function of the residual stretch ratios so as to correspond after complementary stretching to the currently used sizes in this field of application.

The means to overtwist this yarn are such known means as the throwing mill or the two-for-one twisting spindle. As already mentioned, it is enough to twist at about half the rate of the current twisting operations using standard yarns for this application. In this manner, the overtwisting operation can be advantageously carried out in a single step using most of the present-day materials, which again represents a substantial advantage.

The false twist texturing means used may be a single heater present-day equipment, it being borne in mind that:

on one hand the complementary stretching is carried out simultaneously with the false twist (a technique called "indraw"), that is, with the stretching actually in the texturing heater; and on the other hand, the direction of this false twist or, more precisely, the direction of rotation of the spindle is identical with the direction of the overtwist.

The implementation of the invention and the ensuing advantages will be better understood in relation to the illustrative and non-restrictive examples provided below.

EXAMPLE 1

A fancy thread of the invention is manufactured in the following manner:

basic yarn: a POY polyester yarn marketed by E. I. DUPONT DE NEMOURS, 130 dtex/34 strands, practically lacking twists overtwist: this yarn is overtwisted at 600 turn/m into the S shape in a single pass in a two-for-one twisting spindle ACBF, model 3000 texturing: this takes place on a GUIDICI machine with a single heater set at 200° C. and with complementary stretching of the overtwisted POY yarn overtwisted in this heater.

The finished yarn evinces a size of nearly 78 dtex and a twist of about 350 turns/m in the S shape.

EXAMPLE 2

For comparison, a crepe Suzette fabric close to that of Example 1 was made starting from a yarn obtained in a conventional manner using a standard raw yarn (that is, totally stretched) of 78 dtex/34 strands, overtwisted at 110 turns/m into the S shape and textured under the same conditions as in Example 1.

A fabric with a crepe feel and appearance is obtained, but it is less pliant than that obtained in Example 1. Also, the manufacturing cost of this article is much higher due to the higher overtwist required.

EXAMPLE 3

Example 2 is repeated while over twisting the yarn at 350 turns/m into the S shape and by texturing it under the same conditions as in Example 1.

An irregular yarn is obtained, which after weaving evinces unsalable burrs.

Thereby is illustrated in a clear manner the unexpected progress of the invention over the current state of the art to this date, namely:

substantial economies, crepe appearance and improved covering power, and improved flexibility.

What is claimed is:

1. A process for manufacturing fancy yarns having a crepe effect, comprising:

(a) first overtwisting a multifilamentary partially oriented synthetic yarn, and (b) then simultaneously false twist texturing and complementary stretching the overtwisted multifilamentary partially oriented synthetic yarn, said false twist texturing being carried out in the same twist direction as said overtwisting.

2. The process defined in claim 1, wherein a false twist texturing machine performs said false twist texturing, and the complementary stretching is carried out in a heater of said false twist texturing machine.

3. The process defined in either of claims 1 or 2, wherein said multifilamentary partially oriented synthetic yarn is overtwisted to a twist of the order of 600 turns/meter.

* * * * *